United States Patent [19]

Cipolla et al.

[11] Patent Number: 4,850,303

[45] Date of Patent: Jul. 25, 1989

[54] DEVELOPER APPARATUS WITH REMOVABLE DEVELOPER WASTE SUMP

[75] Inventors: Stephen D. Cipolla, Penfield; Paul W. Burnham; Carl W. Holland, both of Webster, all of N.Y.

[73] Assignee: Xerox Corporation, Stamford, Conn.

[21] Appl. No.: 166,584

[22] Filed: Mar. 10, 1988

[51] Int. Cl.[4] ..... G03G 15/08

[52] U.S. Cl. ..... 118/653; 118/657; 118/658; 118/610; 355/260; 222/DIG. 1

[58] Field of Search ..... 118/652, 653, 655, 657, 118/658, 603, 610; 222/DIG. 1; 355/3 DD

[56] References Cited

U.S. PATENT DOCUMENTS

| | | | |
|---|---|---|---|
| 3,685,485 | 8/1972 | Kutsuwada et al. | 118/652 X |
| 4,058,086 | 11/1977 | Jugle et al. | 118/653 |
| 4,325,628 | 4/1982 | Torigai et al. | 118/652 X |
| 4,364,656 | 12/1982 | Yanagawa | 355/3 DD X |
| 4,376,578 | 3/1983 | Tanaka et al. | 118/652 X |
| 4,501,484 | 2/1985 | Shimura | 355/15 |
| 4,614,165 | 9/1986 | Folkins et al. | 118/657 |
| 4,625,895 | 12/1986 | Tsukano | 118/653 X |
| 4,627,716 | 12/1986 | Oka | 355/15 |
| 4,685,798 | 8/1987 | Matsumoto | 355/15 |
| 4,692,017 | 9/1987 | Maczuszenko et al. | 118/658 X |

FOREIGN PATENT DOCUMENTS

| | | | |
|---|---|---|---|
| 0163978 | 9/1983 | Japan | 355/3 DD |
| 0059470 | 3/1986 | Japan | 355/3 DD |

*Primary Examiner*—Shrive Beck
*Assistant Examiner*—Alain Bashore

[57] ABSTRACT

A developer apparatus for electrostatographic printing machine includes a developer assembly having a developer housing containing a developer sump, a developer exit port at the top portion of the sump to purge developer material and a removable developer waste sump for cooperative association with the developer exit port which includes a developer storage chamber, an opening through which developer may enter the chamber which is in developer receiving engagement with the developer exit port on the housing. The developer waste sump has at least one exhaust port above and in communication with the storage chamber to permit air which has any entrained toner removed therefrom to escape from the waste sump and including a pin on the bottom of the waste sump which is releasably secured to a fastening device on the housing. In a preferred embodiment, the developer apparatus also includes a removable developer supply container which is tethered to the developer waste sump by a flexible tether member to enable removal and replacement of the supply container and the developer waste sump at the same time.

20 Claims, 5 Drawing Sheets

DEVELOPER APPARATUS WITH REMOVABLE DEVELOPER WASTE SUMP

CROSS REFERENCE TO RELATED APPLICATION

Reference is hereby made to copending application Ser. No. 07/166583 entitled "Developer Transport Apparatus" in the name of Robert J. Tannascoli et al.(D/87189) issued on Mar. 10, 1989 as U.S. Pat. No. 4,813,531 and filed concurrently herewith.

BACKGROUND OF THE INVENTION

The present invention relates to developer apparatus for electrostatographic printing machines and more particularly to a removable developer waste sump in cooperative association with a developer assembly.

In an electrostatographic reproducing apparatus commonly in use today, a photoconductive insulating member is typically charged to a uniform potential and thereafter exposed to a light image of an original document to be reproduced. The exposure discharges the photoconductive insulating surface in exposed or background areas and creates an electrostatic latent image on the member which corresponds to the image areas contained within the usual document. Subsequently, the electrostatic latent image on the photoconductive insulating surface is made visible by developing the image with developing powder referred to in the art as toner. Most development systems employ a developer material which comprises both charged carrier particles and charged toner particles which triboelectrically adhere to the carrier particles. During development the toner particles are attracted from the carrier particles by the charge pattern of the image areas in the photoconductive insulating area to form a powder image on the photoconductive area. This image may subsequently be transferred to a support surface such as copy paper to which it may be permanently affixed by heating or by the application of pressure. Following transfer of the toner image to a support surface, the photoconductive insulating member is cleaned of any residual toner that may remain thereon in preparation for the next imaging cycle.

In typical commercial applications of such apparatus, the developer material has a limited useful life. By developer material herein, it is intended to define the combination of toner and carrier as the developer. As the developer material is used, toner naturally has to be replenished in the mixture of carrier and toner to insure adequate supply of toner for the development process. In addition, the carrier itself has a limited life due to a variety of problems occurring with continued use. For example, the carrier may become impacted with toner thereby reducing or altering its triboelectric properties particularly with respect to the toner. In addition, it frequently happens that the individual carrier particles are coated with selected material to enhance the triboelectric properties and these coatings after prolonged use can deteroirate or indeed flake off. As the end of the useful life of the developer material approaches the quality of the copies being produced in the printing machine degrades. As the quality of copies produced degrades, the users become displeased resulting in the necessity of a service call by a trained technician to try to improve copy quality. In addition, when the developer material finally does fail, a service call by a trained technician is required to replace the developer material in the apparatus. Accordingly, it is desirable to be able to use developer material throughout the useful life of the electrostatographic machine.

PRIOR ART

Recently, an apparatus and method for providing an extended life development system have been described in U.S. Pat. No. 4,614,165 to Folkins et al. The developing process described therein involves the addition of both toner particles and carrier particles to the developer in the developer housing to insure that the usable life of the developer material in the chamber at any point in time is at least equal to the life of the electrophotographic printing machine. To accommodate the addition of further carrier and toner material, waste or spent developer is removed from the developer housing when it exceeds a pre-determined quantity. The mixture of toner particles and carrier particles added to the developer housing has ratio of toner particles to carrier particles substantially greater than the ratio of toner particles to carrier particles in the developer housing. To facilitate collection and discharge of extraneous developer material, a waste container 70 is provided in FIG. 2 which may be periodically emptied by the machine operator.

SUMMARY OF THE INVENTION

In accordance with a principle aspect of the present invention, a developer waste sump for cooperative association with the developer assembly to remove developer material therefrom is provided which comprises a substantially enclosed developer storage chamber having an opening through which developer may enter, at least one exhaust port above and in communication with the storage chamber to permit air to escape from the exhaust port and means to releasably secure the waste sump to the developer assembly such that the opening in the sump is in developer receiving engagement with the developer exit port on the developer assembly.

In a further aspect of the present invention the exhaust port is at the end of a generally vertically oriented settling chimney for settling entrained particles from the air.

In a further aspect of the present invention the particle removal means comprises a magnet or filter.

In a further aspect of the present invention the opening in the developer waste sump is in the top of the chamber and further comprises a spring biased closure for the opening the closure being openable by engagement with a member on the developer assembly when the waste sump is secured to the developer assembly.

In a further aspect of the present invention a magnet is provided on the top surface of the spring biased closure to prevent leakage of developer material through the gap between the sump opening and the developer exit port.

In a further aspect of the present invention a handle is provided to facilitate handling and placement of the developer waste sump in engagement with the developer exit port on the developer assembly.

In a further aspect of the present invention, two generally vertically oriented settling chimneys at opposite sides of the chamber are provided with a handle means extending between the chimneys to facilitate handling and placement of the waste sump.

In a further aspect of the present invention, the developer waste sump is releasably secured to the developer assembly by a pin on the bottom of the sump which is engageable with a fastener on the developer assembly.

In a further aspect of the present invention, the removable developer waste sump is connected to a removable developer supply container by a tether member.

Pursuant to a further aspect of the present invention, the developer apparatus for electrostatographic printing machine is provided which comprises a developer assembly including a developer housing containing therein a developer sump with a developer exit port at the top portion of the sump to purge developer material, and a removable developer waste sump for cooperative association with the developer exit port.

In a further aspect of the present invention, a developer apparatus includes a removable developer supply container, a removable developer waste sump with the supply container and waste sump being connected by a flexible tether member to enable both the developer supply container and the waste sump to be removed and exchange at the same time.

Other features of the present invention will become apparent as the following description proceeds and upon reference to the drawings.

DESCRIPTION OF THE PREFERRED EMBODIMENT

The invention will now be described with reference to a preferred embodiment of the developer apparatus with removable waste sump in an electrostatographic printing apparatus.

Figure 1:
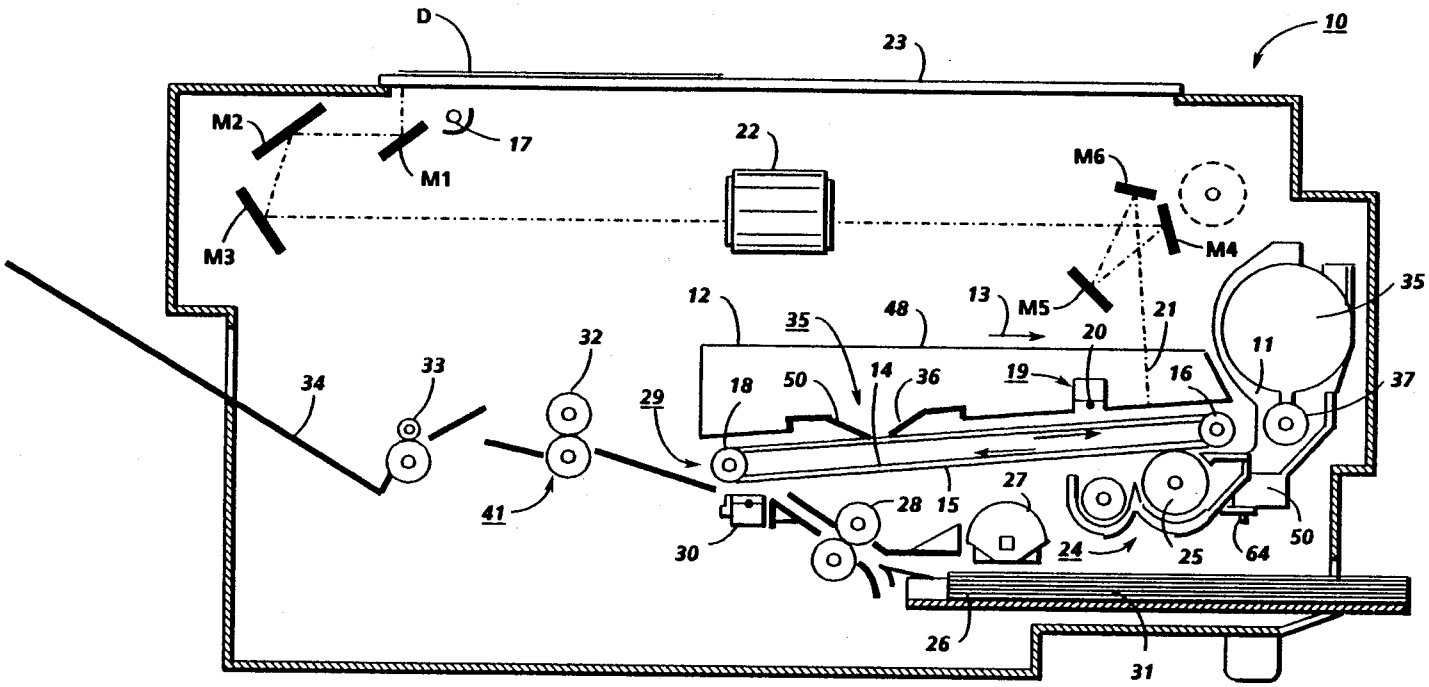
FIG. 1 is a schematic representation in cross section of an automatic electrostatographic reproducing machine with the developer apparatus and developer waste sump according to the present invention.

Referring now to FIG. 1, there is shown by way of example, an automatic electrostatographic reproducing machine 10 which includes a removable processing cartridge employing the developer apparatus with removable waste sump according to the present invention. The reproducing machine depicted in FIG. 1 illustrates the various components utilized therein for producing copies from an original document. Although the apparatus of the present invention is particularly well adapted for use in automatic electrostatographic reproducing machines, it should become evident from the following description that it is equally well suited for use in a wide variety of processing systems including other electrostatographic systems, and is not necessarily limited in application to the particular embodiment or embodiment shown herein.

The reproducing machine 10 illustrated in FIG. 1 employs a removable processing cartridge 12 which may be inserted and withdrawn from the main machine frame in the direction of arrow 13. Cartridge 12 includes an image recording belt like member 14 the outer periphery of which is coated with a suitable photoconductive material 15. The belt is suitably mounted for revolution within the cartridge about driven transport roll 16, around idler roll 18 and travels in the direction indicated by the arrows on the inner run of the belt to bring the image bearing surface thereon past the plurality of xerographic processing stations. Suitable drive means such as a motor, not shown, are provided to power and coordinate the motion of the various cooperating machine components whereby a faithful reproduction of the original input scene information is recorded upon a sheet of final support material 31, such as paper or the like.

Initially, the belt 14 moves the photoconductive surface 15 through a charging station 19 wherein the belt is uniformly charged with an electrostatic charge placed on the photoconductive surface by charge corotron 20 in known manner preparatory to imaging. Thereafer, the belt 14 is driven to exposure station 21 wherein the charged photoconductive surface 15 is exposed to the light image of the original input scene information, whereby the charge is selectively dissipated in the light exposed regions to record the original input scene in the form of electrostatic latent image.

The optical arrangement creating the latent image comprises a scanning optical system with lamp 17 and mirrors $M_1$, $M_2$, $M_3$ mounted to a a scanning carriage (not shown) to scan the original document D on the imaging platen 23, lens 22 and mirrors $M_4$, $M_5$, $M_6$ to transmit the image to the photoconductive belt in known manner. The speed of the scanning carriage and the speed of the photoconductive belt are synchronized to provide faithful reproduction of the original document. After exposure of belt 14 the electrostatic latent image recorded on the photoconductive surface 15 is transported to development station 24, wherein developer is applied to the photoconductive surface 15 of the belt 14 rendering the latent image visible. The development station includes a magnetic brush development system including developer roll 25 utilizing a magnetizable developer mix having course magnetic carrier granules and toner colorant particles as will be discussed in greater detail hereinafter.

Sheets 31 of the final support material are supported in a stack arranged on elevated stack support tray 26. With the stack at its elevated position, the sheet separator segmented feed roll 27 feeds individual sheets therefrom to the registration pinch roll pair 28. The sheet is then forwarded to the transfer station 29 in proper registration with the image on the belt and the developed image on the photoconductive surface 15 is brought into contact with the sheet 31 of final support material within the transfer station 29 and the toner image is transferred from the photoconductive surface 15 to the contacting side of the final support sheet 31 by means of transfer corotron 30. Following transfer of the image, the final support material which may be paper, plastic, etc., as desired, is separated from the belt by the beam strength of the support material 31 as it passes around the idler roll 18, and the sheet containing the toner image thereon is advanced to fixing station 41 wherein roll fuser 32 fixes the transferred powder image thereto. After fusing the toner image to the copy sheet the sheet 31 is advanced by output rolls 33 to sheet stacking tray 34.

Although a preponderance of toner powder is transferred to the final support material 31, invariably some residual toner remains on the photoconductive surface 15 after the transfer of the toner powder image to the final support material. The residual toner particles remaining on the photoconductive surface after the transfer operation are removed from the belt 14 by the cleaning station 35 which comprises a cleaning blade 36 in scrapping contact with the outer periphery of the belt 14 and contained within cleaning housing 48 which has a cleaning seal 50 associated with the upstream opening of the cleaning housing. Alternatively, the toner particles may be mechanically cleaned from the photoconductive surface by a cleaning brush as is well known in the art.

It is believed that the foregoing general description is sufficient for the purposes of the present application to illustrate the general operation of an automatic xerographic copier 10 which can embody the apparatus in accordance with the present invention.

Figure 2:
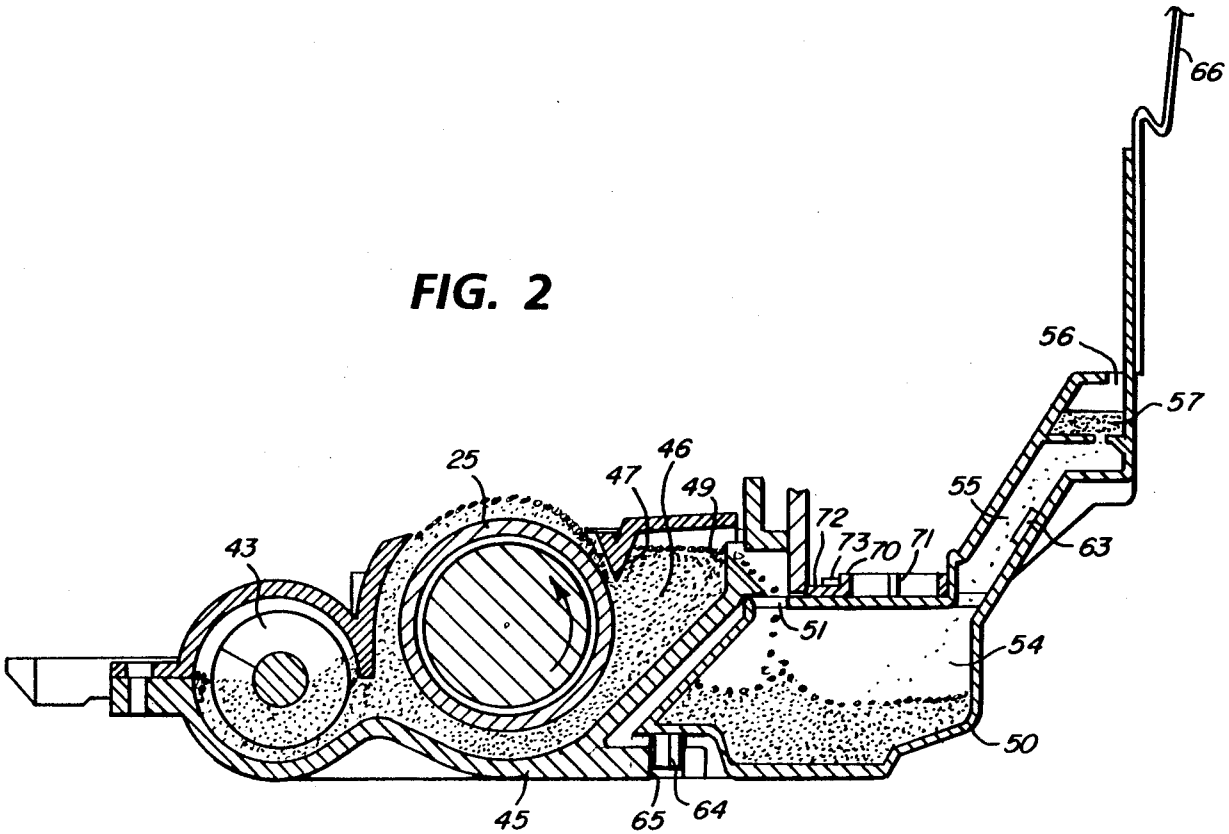
FIG. 2 is an enlarged schematic representation in cross section of a developer assembly with the developer waste sump according to the present invention.
Figure 3:
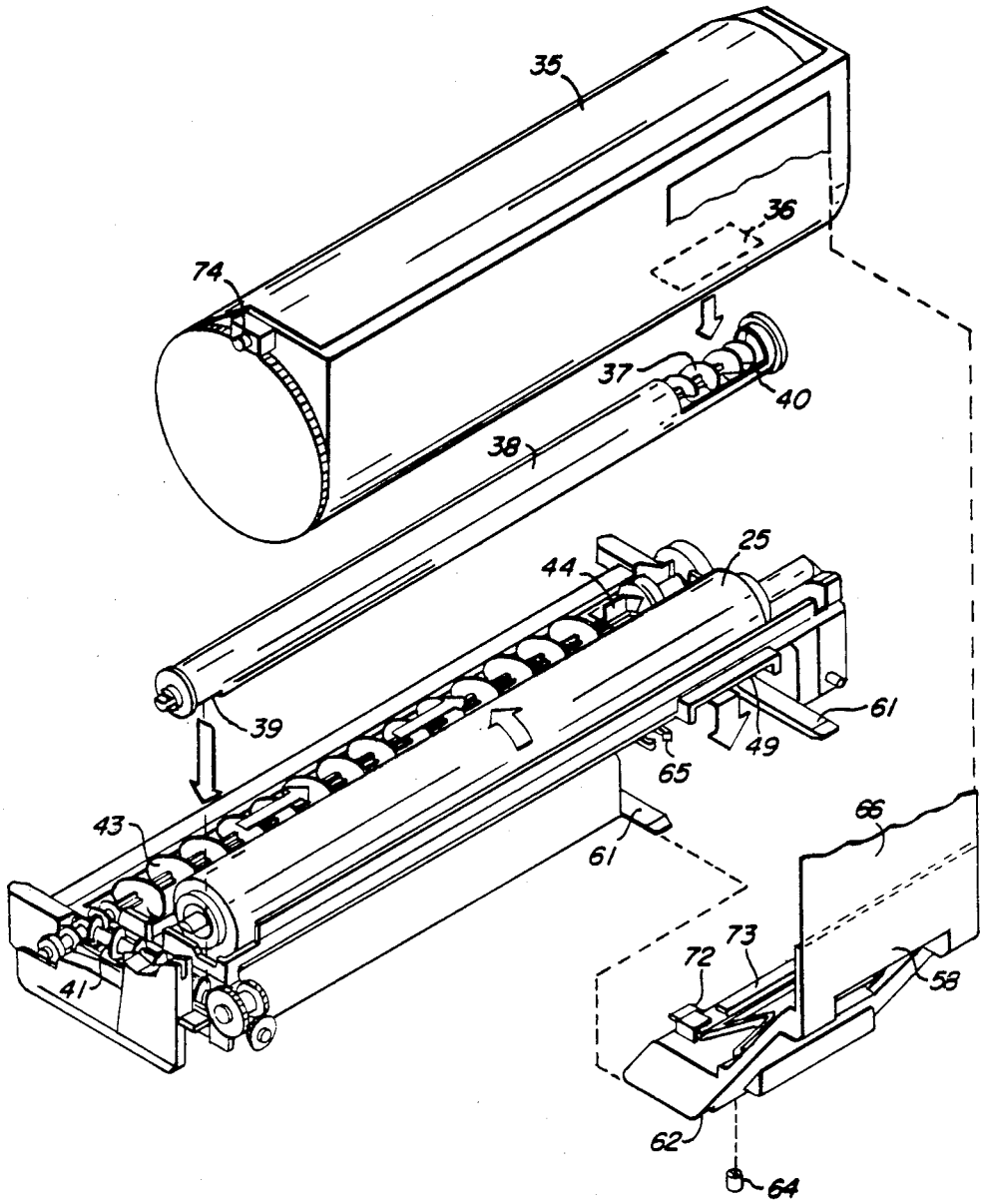
FIG. 3 is a partially exploded isometric view of the developer assembly together with a removable developer supply container and a removable developer waste sump tethered to the supply container.

The operation of the developer assembly 11 will be described with continued reference to FIG. 1 and additional reference to FIGS. 2 and 3. Initially, it should be observed that the developer assembly is itself removable from the main of the machine in the direction of the arrow 13 and includes a removable developer supply or replenisher container 35, developer roll 25, removable developer waste sump 50 as well as associated transport augers 37, 41 and developer mix auger 43. It will of course be appreciated that while FIG. 3 illustrates transport auger 41 and developer mix auger 43 to be opened to the air that they are in use covered by cover members, not shown for purposes of illustration, to reduce contamination in the machine.

The developer supply or replenisher container 35 includes a developer dispensing opening 36 in the bottom thereof which when it is inserted into the developer assembly is in developer dispensing communication with an opening 40 in containment tube 38 of first developer transport auger 37. The developer supply container is inserted into the developer assembly manually and rotated counterclockwise to seat therein about locating pins 74 on each side of the container. Simultaneous with rotation of the container, a door, not shown, over the dispensing opening 36 is opened to release the developer contained therein. A dispensing opening 39 is provided at the downstream or delivery end of the first transport auger 37 to dispense developer to second transport auger 41 under auger 37 which in turn transports developer to the front of the developer assembly dropping down into the developer mix auger which mixes and transport the developer and because of its increased rotational speed provides preliminary charging of the developer. The developer is then transported longitudinally to the opposite end of the developer mix auger at which time it is urged by paddles of paddle wheel 44 through a small door in the back wall (not shown) into the developer sump and in the developer housing. A magnetic brush developer roll 25 is rotatably mounted therein by means not shown to deliver charged developer from the sump 46 to the electrostatic latent image on the photoconductive surface of the belt. In the developer housing 45 the thickness of the developer on the developer roll 25 is trimmed by trim bar 47 prior to its entering the development zone wherein it is brought into contact with the image on the photoconductive insulating layer and subsequently returned to the developer sump 46. The developer in the sump 46 is now transported by angled flutes not shown in the bottom of th sump back to the entrance portion of the developer mix auger. A small blade portion (not shown) is provided at the developer entrance portion of the developer mix auger in the developer sump to direct partially used developer from the developer roll and mix it with new developer as it is being added to the developer mix auger thereby recirculating partially used developer with new developer in the system.

Figure 4:
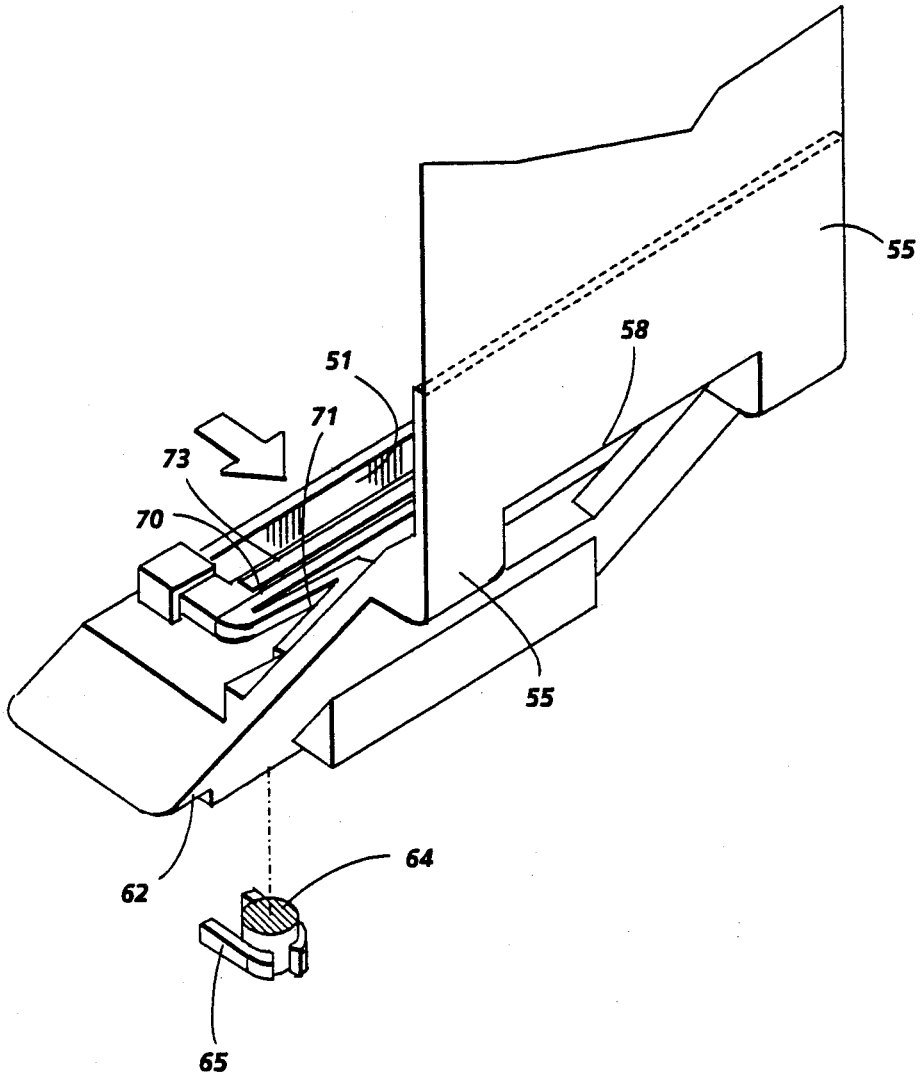
FIG. 4 is an enlarged isometric view of the developer waste sump according to the present invention when it is mounted in the developer assembly.
Figure 5:
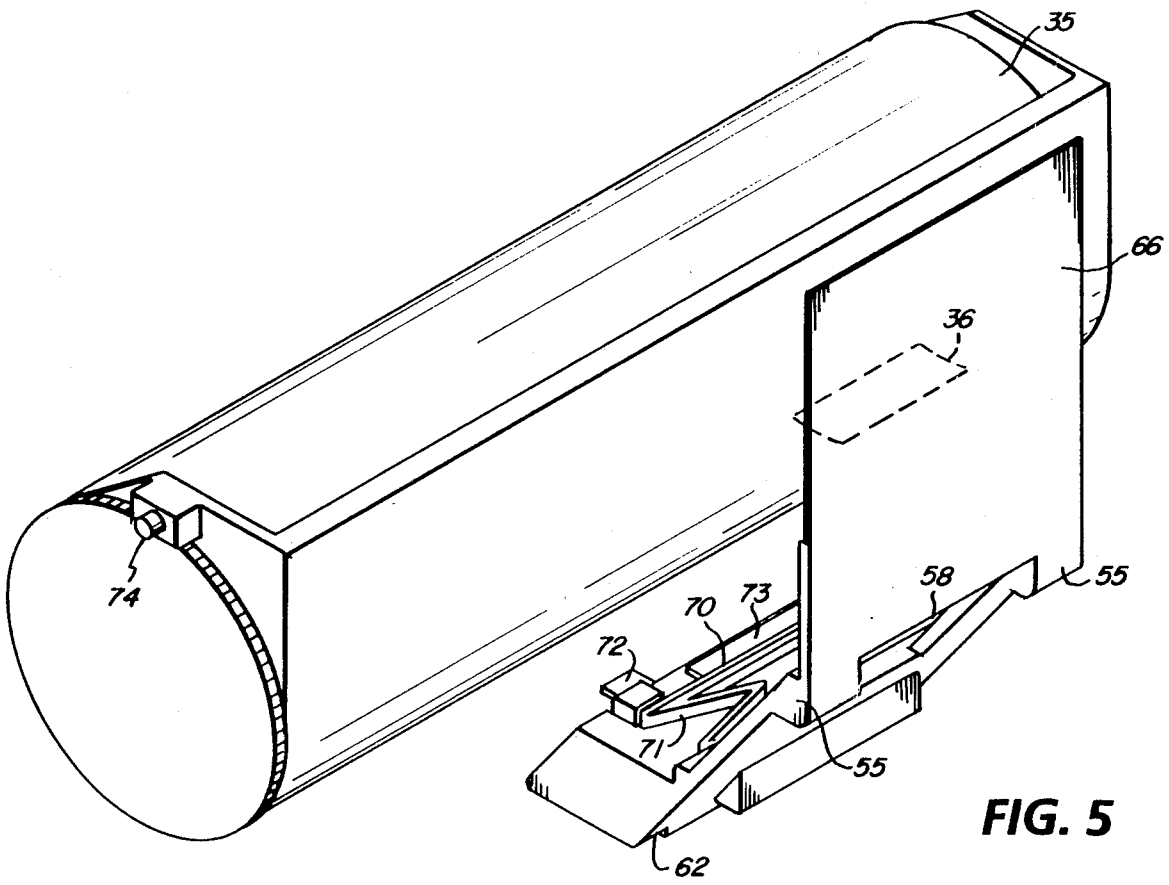
FIG. 5 is an isometric view of the removable developer supply container tethered to the removable developer waste sump.

As new developer is continuously added to the developer system some material needs to be removed when the capacity of the system is reached. This is enabled through a developer exit port 49 in the upper portion of the rear of the developer sump 46 in the developer housing 45. Thus, as new developer is added, some new and indeed some old developer material flows or trickles through the developer exit port 49. Removably positioned and releasably secured to the rear of the developer housing is the developer waste sump 50 which has an opening 51 in communication with developer exit port 49 to receive spent or waste developer in the developer storage chamber 54. The developer waste sump 50 includes at least one settling chimney 55 to enable entrained toner to be removed from the air prior to exhaust and works in cooperation with filter 57 such as a polyurethane foam for that purpose prior to the air exiting the exhaust port 56. Alternatively or in addition thereto a magnet 63 may be placed in the settling chimney to attract the magnetically attractable carrier and toner particles to assist in separating them from the exhaust air. As illustrated in FIGS. 3 to 5, the developer waste sump may include two such settling chimneys 55 connected at the top portion be a member 58 forming a positioning handle for the developer waste sump. With continued reference to FIGS. 3 through 5, the placement of the developer waste sump 50 into the developer assembly will be described in greater detail. The developer waste sump 50 may be inserted manually by the operator holding handling 58 and inserting the waste sump into the cavity formed behind the developer sump 46 in the developer assembly so that the developer exit port 49 on the developer assembly is in communication with opening 51 in the developer waste sump. As the developer waste sump slides into position on runners 61 which slidably engage grooves 62 on opposite side of the waste sump, the tabs 72 of spring 71 engage the developer assembly comprising the spring and forcing the door 70 attached thereto to move rearwardly exposing opening 51 in the top of the developer waste sump. At the same time, at the bottom of the developer waste sump a small pin 64 mounted thereto is engaged by fastening means 65 on the developer assembly 11. Optionally, foam seals such as strips of closed or open celled foam may be placed around the opening 51 or the exit port 49 or both to prevent particulate material from escaping onto the machine. A further option is to provide a magnet 73 on the door 70 extending between tabs 72 to create a magnetic field which will prevent the flow of developer from the door area in the event there is a slight gap between the door and the sump body.

The developer waste sump 50 is connected to the developer supply or replenisher container 35 by means of a tether member 66 which is desirably a flexible plastic material. This arrangement ensures that the developer waste sump will be replaced whenever a developer replenisher supply is provided to the developer housing. Additionally, this has the advantage in that an instruction label may be placed on the tether member to instruct the user how to properly insert both the developer supply or replenisher container as well as the developer waste sump.

Thus, according to the present invention a developer waste sump has been provided which in combination with a developer supply container and development apparatus enables the extended life development system of U.S. Pat. No. 4,614,165 wherein a small quantity of two-component developer controlled by the dispense rate of the system is added into the recirculating supply of developer material in the developer assembly while a small quantity of used developer is removed from the developer sump. The described developer waste sump has been proven effective in collecting purged developer material from the developer sump and in minimizing the contaminants in exhaust air. Furthermore, the contamination control improves overall machine life and makes replacement by the customer very easy. As a result of implementing such a system, the developer charge in the developer housing never has to be replaced by a skilled technician. Rather maintenance of this developer housing may be completed by the customer or machine operator. By the continuous removal of carrier and replacement therewith with new carrier as well as toner service calls due to carrier degradation and contamination resulting therefrom are virtually eliminated. Furthermore, the developer waste sump has the advantage in that any pressure generated in the developer sump which has to be released can be released through the developer waste sump. Otherwise, pressure generated within the developer zone can cause overall machine contamination by toner forced to escape by the excess pressure through any opening in the developer assembly. By providing a path through the developer waste sump with a exhaust port having a foam filter thereover, overall contamination of the machine as well as the surrounding air is minimized. In addition, by providing such a filter in the removable and replaceable developer waste sump, it is also periodically replaced as the developer charge is replenished and as the developer waste sump is replaced thereby maintaining filtering efficiency.

The disclosure of the patent referred to herein is hereby specifically and totally incorporated herein by reference.

While the invention has been described with reference to specific embodiments, it will be apparent to those skilled in the art that many alternatives, modifications and variations may be made. For example, while the invention has been illustrated with reference to a printing machine wherein the electrostatic latent image is formed by optically scanning an original it will be appreciated that the electrostatic latent image may be created in other ways such as by a modulated beam of light from a laser beam. Accordingly, it is intended to embrace all such alternatives modifications as may fall within the spirit and scope of the appended claims.

We claim:

1. A developer waste sump for cooperative association with a developer assembly to remove developer material therefrom comprising a substantially enclosed developer storage chamber, an opening through which developer may enter said chamber, at least one exhaust port above and in communication with the storage chamber to permit air to escape from the waste sump, means to remove particles entrained in the air before the air escapes from the exhaust port, and means to releasably secure said waste sump to said developer assembly such that said opening is in developer receiving engagement with a developer exit port on said developer assembly, and further including a supply container for developer material and a tether member between and connecting said waste sump and said supply container.

2. The developer waste sump of claim 1 wherein said at least one exhaust port is at the end of a generally vertically oriented settling chimney for settling entrained particles from the air.

3. The developer waste sump of claim 2 wherein said particle removal means comprises a filter.

4. The developer waste sump of claim 2 wherein said particle removal means comprises a magnet.

5. The developer waste sump of claim 1 further comprising sealing means around a portion of said opening to provide a seal with the developer exit port on said developer assembly.

6. The developer waste sump of claim 1 wherein said opening is in the top of said chamber and further comprising a spring biased closure for said opening, said closure being openable by engagement with a member on said developer assembly when said waste sump is received in said developer assembly.

7. The developer waste sump of claim 1 wherein said closure has a magnet mounted thereto to create a magnet field to prevent developer from leaking through any gap between closure and the chamber.

8. The developer waste sump of claim 1 further comprising a handle to facilitate handling and placement thereof in developer receiving engagement with the developer exit port on said developer assembly.

9. The developer waste sump of claim 2 comprising two generally vertically oriented settling chimneys at opposite sides of said chamber and further including handle means extending between said chimneys to facilitate handling and placement thereof in developer receiving engagement with the developer exit port on said developer assembly.

10. The developer waste sump of claim 1 wherein said means to releasably secure said waste sump comprises a pin on the bottom of said sump which is releasably engageable with fastening means on the developer assembly.

11. Developer apparatus for an electrostatographic printing machine comprising a developer assembly including a developer housing containing therein a developer sump, said housing having a developer exit port at a top portion of said sump to purge developer material, a removable developer waste sump for cooperative association with said developer exit port comprising a substantially enclosed developer storage chamber, an opening through which developer may enter said chamber, said opening being in developer receiving engagement with said developer exit port on said housing, at least one exhaust port above and in communication with the storage chamber to permit air to escape from the waste sump, means to remove toner entrained in the air before air escapes from the exhaust port, means to releasably secure said waste sump to said developer assmebly, and further including a removable supply container for developer material, said container having means to dispense developer material to said apparatus and said apparatus including means to receive said developer material, said removable supply container and said removable developer waste sump being connected by a flexible tether member.

12. The developer apparatus of claim 11 wherein said means to releasably secure said waste sump comprises a pin on the bottom of said waste sump which is releasably engaged by fastening means on said developer assembly.

13. The developer apparatus of claim 11 wherein said at least one exhaust port in said waste sump is at the end of a generally vertically oriented settling chimney for settling entrained particles from the air.

14. The developer apparatus of claim 13 wherein said particle removal means comprises a filter.

15. The developer apparatus of claim 13 wherein said particle removal means comprises a magnet.

16. The developer apparatus of claim 11 further comprising sealing means around a portion of said opening in said waste sump to provide a seal with the developer exit port on said developer assembly.

17. The developer of claim 11 wherein said opening in said waste sump is in the top of said chamber and further comprising a spring biased closure for said opening, said closure being openable by engagement with a member on said developer assembly when said waste sump is received in said developer assembly.

18. The developer waste sump of claim 11 wherein said closure has a magnet mounted thereto to create a magnet field to prevent developer from leaking through any gap between the closure and the chamber.

19. The developer apparatus of claim 11 wherein said waste sump further comprises a handle to facilitate handling and placement thereof in developer receiving engagement with the developer exit port on said developer assembly.

20. The developer apparatus of claim 13 wherein said waste sump comprises two generally vertically oriented settling chimneys at opposite sides of said chamber and further including handle means extending between said chimneys to facilitate handling and placement thereof in developer receiving engagement with the developer exit port on said developer assembly.

* * * * *